US008248253B2

(12) United States Patent
Ankara

(10) Patent No.: US 8,248,253 B2
(45) Date of Patent: Aug. 21, 2012

(54) FIRE DETECTOR INCORPORATING A GAS SENSOR

(75) Inventor: Zafer Ankara, Neuss (DE)

(73) Assignee: Honeywell International Inc., Morristown, NJ (US)

( * ) Notice: Subject to any disclaimer, the term of this patent is extended or adjusted under 35 U.S.C. 154(b) by 775 days.

(21) Appl. No.: 12/424,187

(22) Filed: Apr. 15, 2009

(65) Prior Publication Data

US 2009/0261980 A1 Oct. 22, 2009

Related U.S. Application Data

(60) Provisional application No. 61/124,977, filed on Apr. 21, 2008.

(51) Int. Cl.
*G08B 17/00* (2006.01)

(52) U.S. Cl. ..... 340/584; 340/632

(58) Field of Classification Search ..... 340/584, 340/517, 521, 522, 577, 506, 511, 514, 588, 340/557, 628, 630, 632
See application file for complete search history.

(56) References Cited

U.S. PATENT DOCUMENTS

| | | | | |
|---|---|---|---|---|
| 4,618,853 | A | 10/1986 | Yuchi | |
| 4,775,838 | A | 10/1988 | Mizuta et al. | |
| 5,372,426 | A * | 12/1994 | Broudy et al. | 374/127 |
| 5,623,212 | A | 4/1997 | Yamanaka | |
| 5,830,412 | A | 11/1998 | Kimura et al. | |
| 5,856,780 | A | 1/1999 | McGeehin | |
| 6,166,647 | A | 12/2000 | Wong | |
| 6,229,439 | B1 * | 5/2001 | Tice | 340/506 |
| 6,958,689 | B2 | 10/2005 | Anderson et al. | |
| 7,333,129 | B2 | 2/2008 | Miller et al. | |
| 2003/0058114 | A1 | 3/2003 | Miller et al. | |
| 2004/0056765 | A1 | 3/2004 | Anderson et al. | |

FOREIGN PATENT DOCUMENTS

| | | |
|---|---|---|
| DE | 196 42 107 A 1 | 4/1998 |
| EP | 0 608 483 A1 | 8/1994 |
| JP | 55132940 A | 10/1980 |
| JP | 60039542 A | 3/1985 |
| JP | 61128149 A | 6/1986 |
| JP | 02151752 A | 6/1990 |
| JP | 06325270 A | 11/1994 |
| JP | 09229887 A | 9/1997 |
| WO | WO 93/08550 | 4/1993 |

OTHER PUBLICATIONS

Thomas Kammerer, Zafer Ankara, Andreas Schutze, GaSTON—a Universal Tool for the Development of Intelligent Gas Sensors Systems, presented at Sensors, Dec. 2003.

(Continued)

*Primary Examiner* — Anh V La
(74) *Attorney, Agent, or Firm* — Husch Blackwell LLP

(57) ABSTRACT

A fire detector incorporates a heatable gas sensor. The sensor is cycled through a plurality of different operating temperature ranges, and one or more outputs at each temperature range are acquired. A plurality of acquired outputs, corresponding to the plurality of temperature ranges, can be coupled in parallel to pattern recognition circuitry. The pattern recognition circuitry can process the acquired outputs and make a determination that the processed data samples are indicative of the presence of a fire condition.

17 Claims, 4 Drawing Sheets

OTHER PUBLICATIONS

T. Kammerer, Z. Ankara and A. Schutze, GaSTON—a Versatile Platform for Intelligent Gas Detection Systems and its Application for fast Discrimination of Fuel Vapors, presented at Eurosensors XVII, Guimaraes, Portugal, Sep. 22-24, 2003.

A. Gramm, Z. Ankara and A. Schutze, Selective Gas Sensor Systems based on Temperature Cycling and Comprehensible Pattern Classification: a Systematic Approach, presented at Eurosensors XVII, Guimaraes, Portugal, Sep. 22-24, 2003.

Zafer Ankara, Thomas Kammerer, Andreas Gramm, Andreas Schutze, Low power virtual sensor array based on a micromachined gas sensor for fast discrimination between H2, CO and relative humidity, Sensors & Actuators B 100 (2004) pp. 240-245 and presented at E-MRS 2003 Spring Meeting, Symposium N. Strasbourg, France, Jun. 10-13, 2003.

Ankara, Zafer; Kammerer, Thomas; Engel, Markus; Nagel, Harald; Schutze, Andreas, Efficient and cost-saving test method for fire detectors based on metal-oxide semiconductor gas sensors; Sensor 2005, Conference Part B, vol. 2, pp. 109-114, May 12, 2005.

English translation of Abstract of EP 0 608 483 A1.

English translation of Abstract of DE 196 42 107 A 1.

English translation of Abstract of JP55132940 A.

English translation of Abstract of JP60039542 A.

English translation of Abstract of JP61128149 A.

English translation of Abstract of JP02151752 A.

English translation of Abstract of JP06325270 A.

English translation of Abstract of JP09229887 A.

Ghennady Korotchenkov, Vladimir Brynzari, Serghei Dmitriev, SnO2 thin film gas sensors for fire-alarm systems, Sensors and Actuators B 54 (1999) 191-196.

R. Gutierrez-Osuna, S. Korah and A. Perera, Multi-Frequency Temperature Modulation for Metal-Oxide Gas Sensors, Proceedings of the 8th Intl. Symp. on Olfaction and Electronic Nose, Washington, D.C., Mar. 25-30, 2001.

G. Korotcenkov, V. Golovanov, V. Brinzari, A. Cornet, J. Morante, and M. Ivanov, Distinguishing feature of metal oxide films' structural engineering for gas sensor applications, Journal of Physics: Conference Series 15 (2005) 256-261; Sensors & their applications XIII; Institute of Physics Publishing.

New Electronic Nose Artinos, SPECS (http://wwww.specs.com/products/Kamina/Kamina.htm), Jan. 22, 2007.

* cited by examiner

FIRE DETECTOR INCORPORATING A GAS SENSOR

CROSS-REFERENCE TO RELATED APPLICATION

This application claims the benefit of the filing date of U.S. Provisional Application Ser. No. 61/124,977 filed Apr. 21, 2008 and entitled "Smoke and Gas Detectors". The '977 application is hereby incorporated herein by reference.

FIELD

The invention pertains to fire detectors. More particularly, the invention pertains to such detectors which incorporate a gas sensor.

BACKGROUND

Various devices and methods have been developed to detect developing or actual fire conditions. These include smoke detectors, flame detectors and thermal detectors. In these detectors, advantage is taken of being able to sense one or more parameters associated with the presence of combustion from a fire condition, namely, air born particulate matter, optical characteristics of flames, or heat from a fire.

Despite the fact that the above identified types of detectors are useful for their intended purposes, they at times suffer from generating false alarms. For example, conventional fire detectors are known to generate false alarms in areas such as residential or commercial kitchens, smoking rooms, chicken coops. In addition, they may not be suitable for use in chemical laboratories, or, production areas.

In connection with the kitchen problem, the presence of hot steam and dense vapor makes fire detection in residential and commercial kitchens a particularly difficult task for conventional fire detectors. Detecting the white and, in some cases, dense water vapor emitted by ovens and pans presents an on-going challenge for both ion-type and optical measurement techniques, where the goal is to reliably detect fire aerosols. It is therefore preferable, at times, to use thermal detectors in such situations. However, thermal detectors also have their limits when used in a kitchen environment, as the presence of hot steam can cause temperature rises of more than 50 C.

There is thus a continuing need for improvements in connection with fire detection. It would be desirable to be able to base fire determinations on additional, alternate fire related parameters. Alternate types of determinations could be used alone or in combination with smoke, heat or flame based determinations of the presence of a fire.

BRIEF DESCRIPTION OF THE DRAWINGS

FIG. 1A is a graph illustrating general sensor temperature cycling of a detector as in FIG. 1;

DETAILED DESCRIPTION

Figure 1:
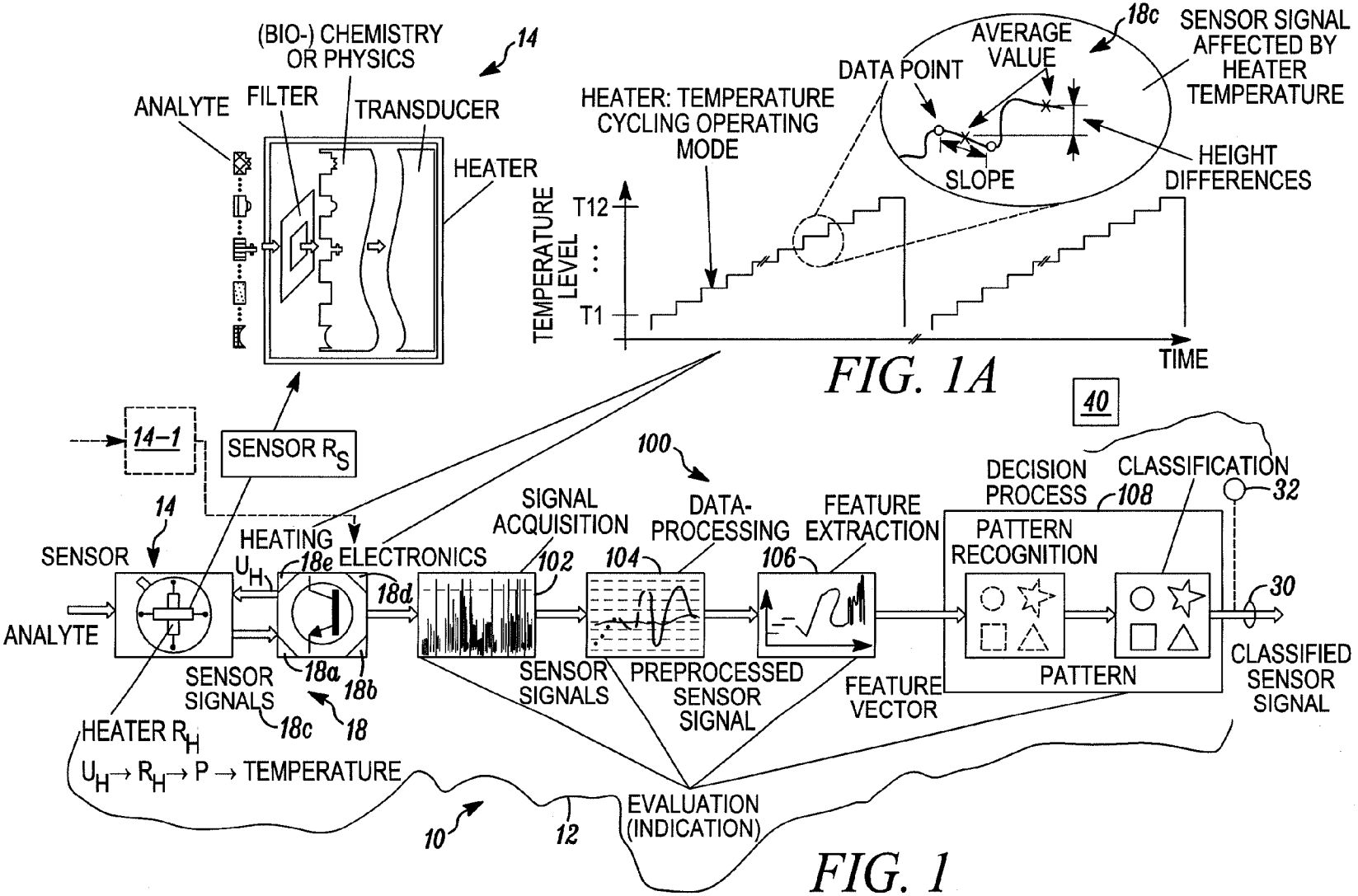
FIG. 1 is a block diagram of a detector in accordance with the invention.

While embodiments of this invention can take many different forms, specific embodiments thereof are shown in the drawings and will be described herein in detail with the understanding that the present disclosure is to be considered as an exemplification of the principles of the invention, as well as the best mode of practicing same, and is not intended to limit the invention to the specific embodiment illustrated.

A fire detector which embodies the invention incorporates a heatable gas sensor. The sensor can be cycled through a plurality of different operating temperature ranges, and one or more outputs at each temperature range are acquired. A plurality of acquired outputs, corresponding to the plurality of temperature ranges, can be coupled in parallel to pattern recognition circuitry. The pattern recognition circuitry can process the inputs and make a determination that the processed data samples are indicative of the presence of a fire condition.

In yet another aspect of the invention, commercially available, micromachined, heatable gas sensors can be used to sense one or more gases associated with actual or developing combustion. Operating temperatures of such sensors can be varied over a period of time and sensor outputs can be sampled one or more times for each operating temperature. Acquired data can represent a fire profile which can be recognized using trained pattern recognition circuitry. For example multivariate linear analysis, linear discriminant analysis can be implemented in one form of pattern recognition circuitry which can process the temperature based sensor outputs to make a determination as to the presence of combustion.

In one aspect of the invention, processing of sampled data can take place locally and an indicator, such as an audible or visual alarm, or an electronic signal can be generated to provide a local alert in response to detection of a fire condition. In another aspect of the invention, sampled data processing can take place at a location remote from the sensor. Detectors which embody the invention can be implemented as stand alone devices, or as devices which are part of a regional monitoring and alarm system, all without limitation.

FIG. 1 illustrates a fire detector 10 which embodies the present invention. Detector 10 includes a housing 12. The housing 12 carries a heatable gas sensor 14. A variety of commercially available, heatable gas sensors can be used without departing from the spirit and scope of the invention. A preferred type of sensor is represented by MiCS 5131-type sensors produced by Microchemical Systems of Switzerland.

Detector 10 includes control circuits 18 which could be implemented, at least in part by a programmable processor 18*a* and associated, executable control software 18*b* which can be stored on a computer readable medium.

Control circuits 18 couple heater control signals, such as signals Uh to the sensor 14. Such signals cycle operating temperature of the sensor 14 repetitively through a series of temperatures, as illustrated in FIG. 1A. Sensor signals 18*c*, which are indicative of sensed incoming gases, analyte, and current sensor temperature can be sampled one or more times, best seen in FIG. 1A, by the control circuits 18.

Control circuits 18 include pattern recognition circuitry 18*d* which can process sets of data, corresponding to one temperature variation cycle, as in FIG. 1A, and classify, or determine, the type of fire condition or profile that has been recognized.

Steps carried out can include, signal or data acquisition 102, data processing 104 as would be understood by those of skill in the art, feature extraction 106, and decision processing 108. A classified, or determination, signal 30 provides input as to the type of fire profile that has been recognized.

Signal 30 can be coupled to a local audible/visual output device 32, Alternately, detector 30 can be part of a multi-detector monitoring system, and determination signal 30 can be coupled via interface circuits 18*e*, and via a wired or wireless medium to a displaced monitoring system indicated generally at 40.

It will also be understood that some or all of the processing 100 can be carried out at the alarm, monitoring system 40 via one or more programmable processor therein along with associated control software, store on a computer readable medium.

While processing 100 can be implemented, at least in part, by linear discriminant analysis to implement the decision process 108, other types of pattern recognition processing or, units come within the spirit and scope of the invention. These include, without limitation, principal component analysis units, neural networks, cluster analysis units, fuzzy logic systems of all types as well as units which implement stochastic methods. Further, as those of skill in the art will understand, in at least some instances, the recognition, or determination units may need to be trained ahead of time to achieve the desired recognition levels.

In an evaluation of performance of detectors, such as the detector 10, which embody the present invention, units were installed and tested in a cafeteria kitchen of the assignee hereof, and under the control of the inventor. Furthermore, in evaluating this approach it was determined that five different temperature levels are sufficient to train the system to detect European Standard EN 54-compliant fires.

The actual temperature profiles depend on the application and the kinds of gases that need to be detected. Optimizing the profile in this manner to include only the truly relevant temperature levels has the inherent advantage of reducing power consumption. Additionally, if heating pauses are used, the average power consumption of 80 mW can be reduced further to approx. 1 mW, as shown in Table 1.

TABLE 1

Calculation of MiCS 5131 power consumption;

| | 1 mW-Cycle | | | |
|---|---|---|---|---|
| Sensor-Type | $U_H$ [V] | $R_H$ [Ω] | P [mW] | T [° C.] |
| MiCS 5131 | 3.20 | 109.3 | 93.69 | 490 |
| | 3.00 | 106.8 | 84.27 | 458 |
| | 2.90 | 104.4 | 80.56 | 426 |
| | 2.75 | 102.1 | 74.07 | 395 |
| | 2.60 | 99.7 | 67.80 | 362 |
| $P_{average}$ | ~80 mW | | | |
| $P_{average}$ | with 14.75 s heating pauses → 1.33 mW | | | |

$R_H$ = heating resistance,
$U_H$ = operating voltage,
$P_{average}$ = average power,
T = temperature.

Figure 2:
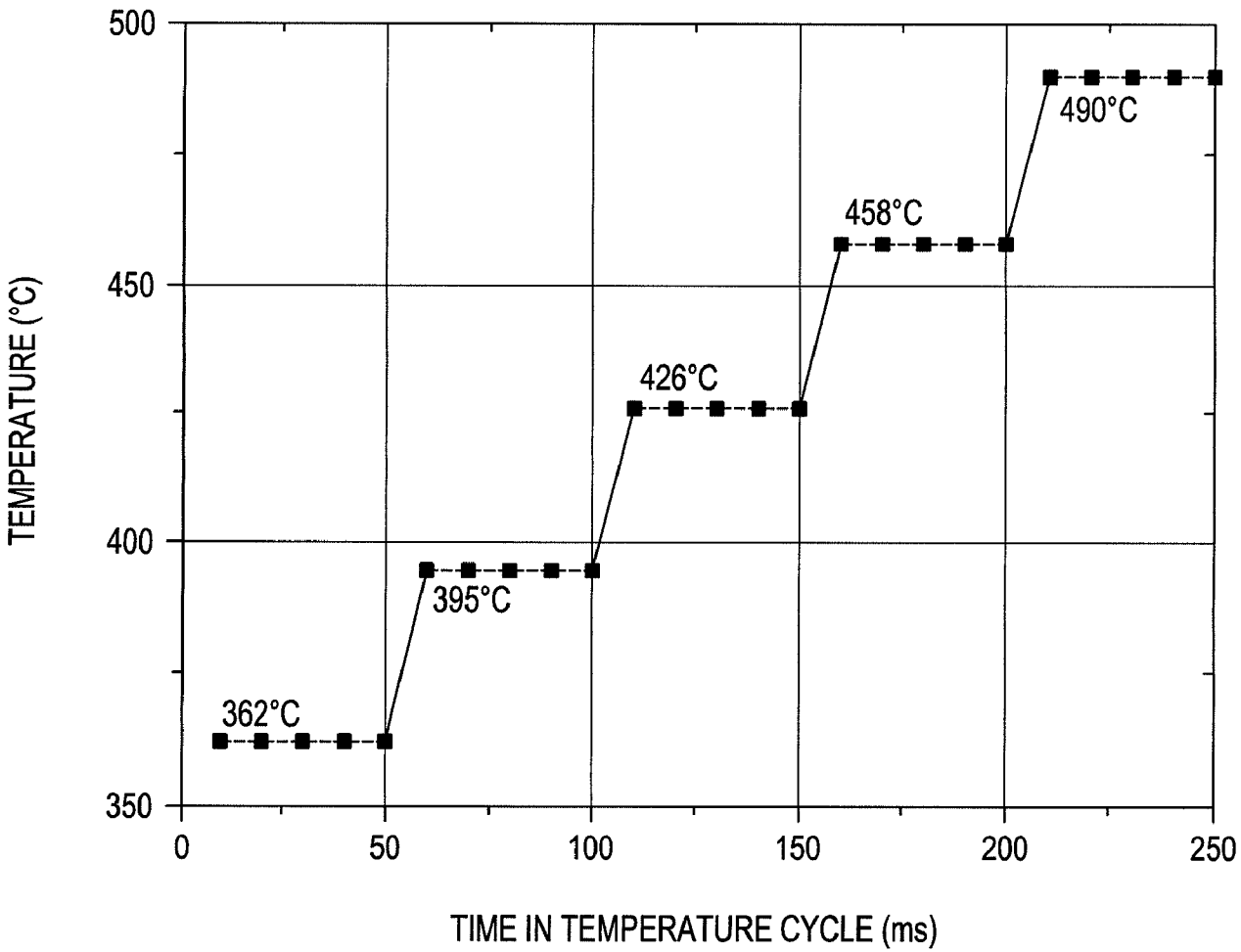
FIG. 2 is a graph of specific sensor temperature variation, or cycling, as a function of time in a detector as in FIG. 1.

FIG. 2, illustrates an exemplary five step heater cycle sensor operating profile, which is exemplary of the tested detectors, such as detector 10. It will also be understood that various operating modes, such as constant temperature levels, sinusoidal or sawtooth-shaped temperature curves can be implemented using control circuits, such as circuits 18, depending on characteristics of the respective sensor 14 without departing from the spirit and scope of the invention. Further one or more data points can be acquired at each temperature level.

Figure 3:
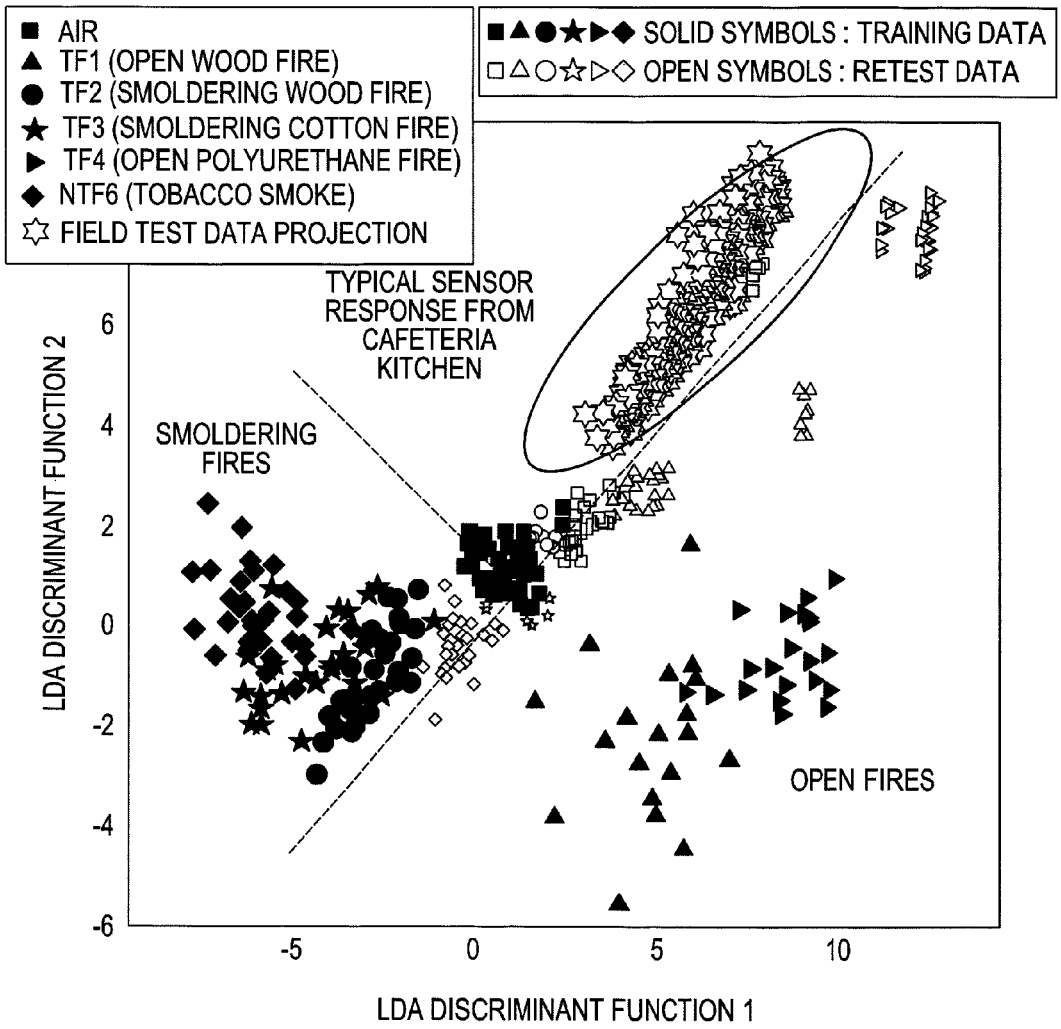
FIG. 3 is a diagram illustrating exemplary discrimination of various ambient conditions by a detector which embodies the invention.

During kitchen activities and regardless of the bank holiday, the gas sensor data from the kitchen are projected in a different sector preventing confusion with fires based on training data, as shown in FIG. 3. In FIG. 3, the training data projections are plotted with solid symbols. Open symbols represent the data projections of retests six months after initial tests were made to evaluate longer term sensor functionality. These retest data show that the sensor exhibits considerable drift after this operation period. However, the principal direction of the projections in the linear discriminant analysis (LDA) plot is still recognizable meaning that open or smoldering fires could still be identified. This drift is depending on the sensor operation and is also influenced by the surrounding atmosphere. Hence, sensor response caused by normal kitchen activities can be discriminated from trained alarm situations by detectors such as the detector 10.

Figure 4:
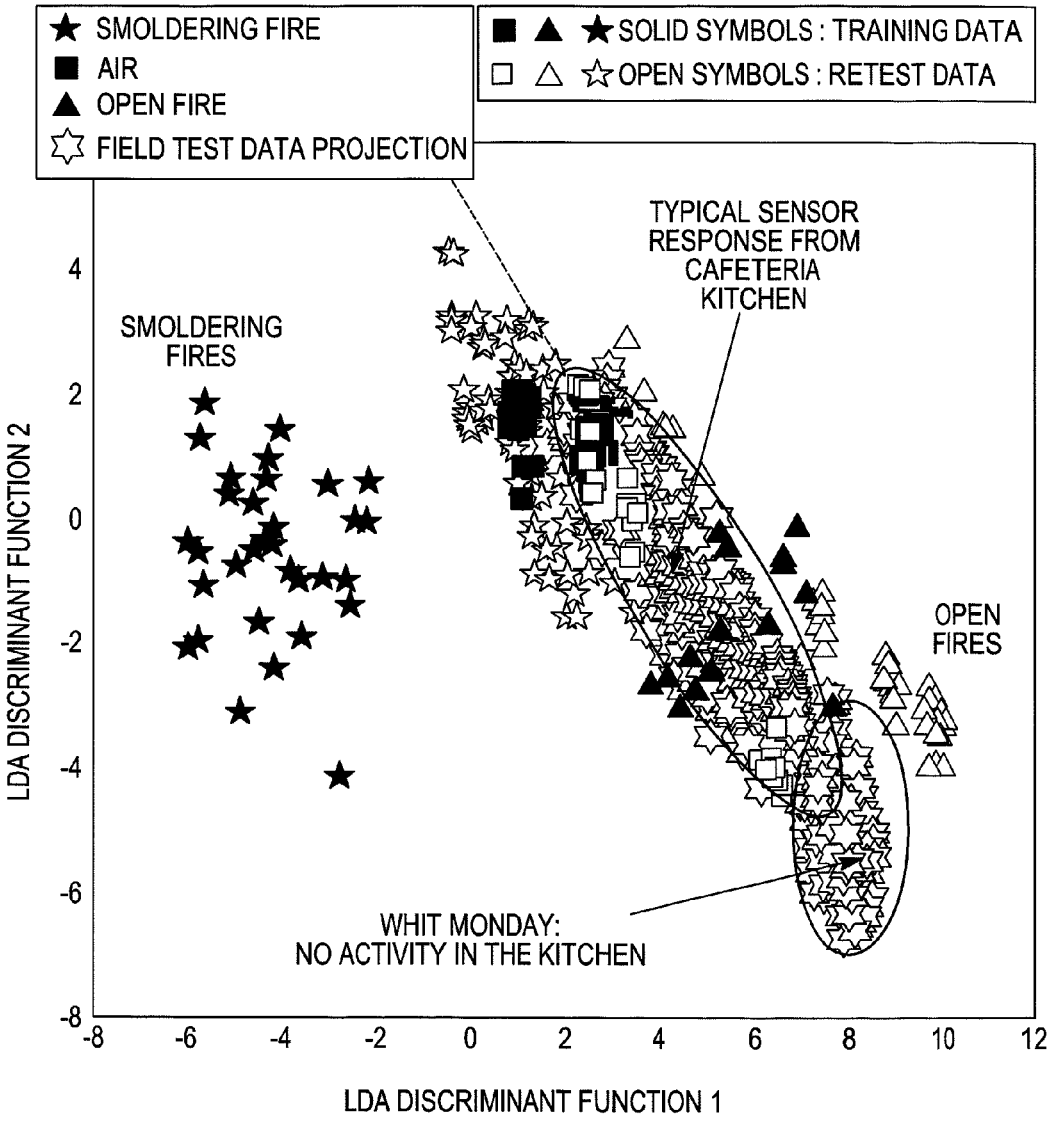
FIG. 4 is a diagram illustrating exemplary discrimination of other ambient conditions by a detector which embodies the invention.

After combining all smoldering fire data into one group and open fire data into another group of parameters as input for a new LDA projection, the result shows that the data projection relative to a non-working holiday, Whit Monday (no kitchen activities) can be readily separated from data gathered during normal kitchen activities as seen in FIG. 4.

It will also be understood that one or more additional smoke or thermal sensors such as 14-1, indicated in phantom, can be carried by housing 12 coupled to control circuits 18. Such additional sensors can be used to provide additional information as to ambient conditions, including developing fire conditions. Outputs from such sensors can be evaluated by the control circuits 18 along with the evaluated outputs from gas sensor 14 to provide a multi-sensor based indicator of a developing fire condition.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A fire detector comprising:

a gas sensor; and control circuitry coupled to the gas sensor, the control circuitry includes control circuits that heat the gas sensor in order to repetitively cycle the gas sensor through a plurality of different operating temperatures ranges, the control circuitry also including pattern recognition circuitry to evaluate pluralities of sampled output data from the sensor, as a function of gas sensor operating temperature in each of the plurality of different operating temperature ranges, to determine the presence of a fire.

2. A detector as in claim 1 where the sensor comprises a heatable sensor of selected gases.

3. A detector as in claim 2 where the control circuitry includes heater control circuitry coupled to the sensor.

4. A detector as in claim 3 where the heater control circuitry applies a plurality of different energy levels to the sensor to establish a corresponding plurality of sensor temperature levels.

5. A detector as in claim 4 where members of a plurality of sampled output data correspond to members of the plurality of sensor temperature levels.

6. A detector as in claim 5 where at least one data sample is obtained from the sensor for each temperature level.

7. A detector as in claim 6 where at least two data samples are obtained from the sensor for each temperature level.

8. A detector as in claim 2 where the pattern recognition circuitry carries out a fire determination and where the pattern recognition circuitry implements processing that is selected from a class which includes at least, linear discriminant analysis, neural net analysis, principal component analysis, cluster analysis, fuzzy logic analysis, or stochastic processing.

9. A detector as in claim 8 where members of a plurality of sensor sampled output data are coupled in parallel to the pattern recognition circuitry.

10. A detector as in claim 6 where members of a plurality of sensor sampled output data are coupled in parallel to the pattern recognition circuitry.

11. A detector as in claim 9 where the members of the plurality of sensor sampled output data correspond to members of a plurality of sensor temperature levels.

12. A method of fire detection comprising:

control circuits heat a gas sensor in order to repetitively cycle the gas sensor through a plurality of different operating temperatures ranges;

control circuits sensing at least one airborne ambient gas from the gas sensor at at each of the plurality of different temperatures;

control circuits producing a set of gas concentration sample values, each corresponding to a respective temperature sequence of the plurality of different temperature ranges; and control circuits analyzing the samples in parallel to determine if they are indicative of a fire condition.

13. A method as in claim 12 which includes obtaining a plurality of sets of gas concentration samples corresponding to a plurality of temperature sequences, and determining if the sets of gas concentration samples correspond to a profile of a fire condition.

14. A method as in claim 12 where determining includes carrying out pattern recognition processing.

15. A method as in claim 14 where the pattern recognition processing is selected from a class which includes at least, linear discriminant analysis, neural net analysis, principal component analysis, cluster analysis, fuzzy logic analysis, or stochastic processing.

16. A fire detector comprising:

a housing;

at least one of a smoke sensor, or a thermal sensor carried by the housing;

at least one gas sensor carried by the housing; and control circuits, carried at least in part by the housing, coupled to the sensors, where the control circuits heat the at least one gas sensor in order to repetitively cycle the gas sensor through a plurality of different operating temperatures and acquire at least one sample at each temperature, the control circuits evaluate the acquired samples to determine if they correspond to a fire profile, the control circuits evaluate an output from the at least one smoke sensor or thermal sensor to determine if a fire condition is being indicated thereby, where the control circuits establish a composite output responsive to the determinations as to the existence of a fire condition.

17. A detector as in claim 16 where the control circuits acquire samples from a plurality of temperature cycles and process the acquired samples to determine if they exhibit a fire profile.

* * * * *